US010292548B2

(12) United States Patent
Marra

(10) Patent No.: US 10,292,548 B2
(45) Date of Patent: May 21, 2019

(54) REMOVABLE URINE DEFLECTING TOILET SEAT ATTACHMENT

(71) Applicant: Sweet Home Ventures, LLC, Glenmoore, PA (US)

(72) Inventor: Patrick Marra, Glenmoore, PA (US)

(73) Assignee: SWEET HOME VENTURES, Glenmore, PA (US)

( * ) Notice: Subject to any disclaimer, the term of this patent is extended or adjusted under 35 U.S.C. 154(b) by 0 days.

(21) Appl. No.: 14/713,125

(22) Filed: May 15, 2015

(65) Prior Publication Data

US 2015/0330066 A1 Nov. 19, 2015

Related U.S. Application Data

(60) Provisional application No. 61/993,355, filed on May 15, 2014.

(51) Int. Cl.
*E03D 9/00* (2006.01)
*A47K 13/24* (2006.01)

(52) U.S. Cl.
CPC ..... *A47K 13/24* (2013.01); *E03D 9/00* (2013.01)

(58) Field of Classification Search
CPC ..... A47K 13/10; A47K 13/105; A47K 10/14; A47K 3/001–3/005; A47K 1/08–1/09; E03D 9/00
USPC ..... 248/309.4, 683; 4/237, 246.1, 300.3, 4/661, 902, 658, 229–231, 654; 220/483; 335/285
See application file for complete search history.

(56) References Cited

U.S. PATENT DOCUMENTS

| | | | | |
|---|---|---|---|---|
| 936,714 | A | 10/1909 | Gunton | |
| 964,533 | A | 7/1910 | McDonald | |
| 3,931,649 | A | 1/1976 | Jankowski | |
| 4,062,070 | A | 12/1977 | Prince | |
| 4,709,426 | A | 12/1987 | Godwin, Jr. | |
| 4,888,835 | A * | 12/1989 | Baumann | A47K 3/001 4/609 |
| 5,625,905 | A | 5/1997 | Woods | |
| 5,732,416 | A | 3/1998 | Albert | |
| 5,887,291 | A | 3/1999 | Bellizzi | |
| 6,055,681 | A | 5/2000 | Lyons | |
| 6,305,034 | B1 | 10/2001 | Perez Urrutia | |
| 6,305,656 | B1 * | 10/2001 | Wemyss | A47G 23/0216 206/5 |
| 6,408,447 | B1 | 6/2002 | Burbank et al. | |

(Continued)

*Primary Examiner* — Paul R Durand
*Assistant Examiner* — Nicholas A Ros
(74) *Attorney, Agent, or Firm* — Myron Greenspan; Lackenbach Siegel LLP

(57) ABSTRACT

A urine deflecting toilet seat attachment includes a generally arcuate guard, removably attachable to a toilet seat. The guard has a top member defining a curvature complementary to a curvature along a generally central front portion of the toilet seat, and a generally arcuate projecting member projecting downwardly from the top member and defining a curvature complementary to a curvature along a generally central front portion of an inside surface of the upper rim of a toilet. When the guard is removably attached to the toilet seat, and the toilet seat is in a seated position, the projecting member projects downwardly to an elevation below the upper rim of the toilet, thereby covering the gap between the upper rim of the toilet and the toilet seat along a generally central front portion of the toilet.

9 Claims, 3 Drawing Sheets

(56) References Cited

U.S. PATENT DOCUMENTS

| | | | | |
|---|---|---|---|---|
| 6,409,091 | B1 * | 6/2002 | Simpson | A63H 19/00 238/10 A |
| 6,550,075 | B1 | 4/2003 | Brannon, III | |
| 8,266,731 | B2 | 9/2012 | Marra | |
| 2002/0194672 | A1 | 12/2002 | Devereux | |
| 2006/0096015 | A1 | 5/2006 | Lim | |
| 2007/0056086 | A1 | 3/2007 | Raviendran | |
| 2008/0016607 | A1 * | 1/2008 | Cottage | A47K 13/24 4/300.3 |
| 2009/0255050 | A1 * | 10/2009 | Lebrun | A47K 3/161 4/584 |
| 2014/0157501 | A1 * | 6/2014 | D'Amico | E03D 13/005 4/256.1 |

* cited by examiner

REMOVABLE URINE DEFLECTING TOILET SEAT ATTACHMENT

CROSS-REFERENCE TO RELATED APPLICATIONS

This application claims priority to U.S. Provisional Patent Application No. 61/993,355, filed on May 15, 2014, entitled "Removable Urine Deflecting Toilet Seat Attachment," the entire contents of which are incorporated by reference herein.

BACKGROUND OF THE INVENTION

The present invention is generally directed to a urine deflector, and, more particularly, to a urine deflecting toilet seat attachment removably mountable to an underside of a toilet seat to prevent urine from splashing, squirting, or leaking between the rim of a toilet bowl and an attached toilet seat.

During normal, everyday use of toilets, the exterior and rim of a toilet bowl are often contaminated for well-known reasons. For example, when men urinate from the standing position, misdirected and splashed urine builds up on the toilet bowl rim, and potentially drips down along the exterior of the toilet bowl. Alternatively, some men elect to urinate from the sitting position. For example, elderly men unable to stand for prolonged periods of time may elect to urinate from the sitting position. As another example, some men may elect to urinate from the sitting position to maximize urine containment within the bowl. However, if a man does not properly direct his urine stream while in the sitting position, urine may still splash, squirt, or leak between the toilet bowl rim and the toilet seat thereby contaminating the toilet bowl rim and exterior (if urine drips down from the rim).

Further, some side effects of ailments often experienced by elderly men include difficulty controlling urine stream. Prescribed medications for elderly men often result in similar side effects, ultimately leading to urine splashing, squirting, or leaking between the toilet bowl rim and the toilet seat. As another example, a percentage of healthy younger males become erect while sleeping and need to urinate upon waking up, while still having an erection. Therefore, they generally cannot urinate while standing. However, even upon sitting down, the erection causes urine to stream near the top of the toilet bowl and can flow through the gap between the toilet bowl rim and the toilet seat or run up and over toilet bowl, onto floor and/or clothing. As yet another example, young children, transitioning from "training" toilet seats to standard seats, also tend to sit very close to the front of the seat due to their size and initial fear of falling in. This often also leads to urinating through the gap between the toilet seat and the toilet bowl rim. Urine can also hit the toilet bowl close to the top and run up and over the toilet bowl, onto the floor and/or clothing. Generally, the task of cleaning a toilet is time consuming and understandably unpleasant.

Previous attempts at solving this problem include providing toilet seats having integral urine deflectors or securely fixing urine deflectors to toilet seats. However, one drawback associated with integrating a urine deflector into the toilet seat is that it requires manufacturing of new toilet seats, and is not usable with existing toilet seats. Another problem associated with fixedly securing a urine deflector to the toilet seat arises when the urine deflector itself gets contaminated. Because the urine deflector is fixedly secured to the toilet seat, the urine deflector requires cleaning at the toilet itself.

Therefore, it would be advantageous to manufacture an improved urine deflector, removably attachable to the toilet seat. Accordingly, a user may merely replace the urine deflector once the deflector becomes contaminated. Alternatively, a user may remove the urine deflector from the toilet seat, separately clean/decontaminate the urine deflector away from the toilet, and reattach the clean/decontaminated urine deflector thereafter.

BRIEF SUMMARY OF THE INVENTION

Briefly stated, one aspect of the present invention is directed to a urine deflecting toilet seat attachment for assembly to a toilet having a toilet bowl defining a curved upper rim and a curved toilet seat pivotably attached to the toilet bowl. The toilet seat is movable between an upright position and a seated position, and defines a gap between the upper rim and the toilet seat in the seated position thereof. The urine deflecting toilet seat comprises a generally arcuate guard, removably attachable to the toilet seat. The guard has a top member defining a curvature complementary to a curvature along a generally central front portion of the toilet seat, and a generally arcuate projecting member projecting downwardly from the top member and defining a curvature complementary to a curvature along a generally central front portion of an inside surface of the upper rim of the toilet. When the guard is removably attached to the toilet seat, and the toilet seat is in a seated position, the projecting member projects downwardly to an elevation below the upper rim of the toilet, thereby covering the gap between the upper rim and the toilet seat along a generally central front portion of the toilet.

Another aspect of the present invention is directed to a urine deflecting toilet seat attachment, for assembly to a toilet having a toilet bowl defining a curved upper rim and a curved toilet seat pivotably attached to the toilet bowl. The toilet seat is movable between an upright position and a seated position, and defines a gap between the upper rim and the toilet seat in the seated position thereof. The urine deflecting toilet seat attachment comprises a magnetic plate defining a curvature complementary to a curvature along a generally central front portion of the toilet seat and an adhesive layer on the magnetic plate for adhesively attaching the magnetic plate to an underside of the toilet set. The urine deflecting toilet seat attached further comprises a generally arcuate guard having a top member defining a curvature complementary to the curvature of the magnetic plate, a generally arcuate projecting member projecting downwardly from the top member and defining a curvature complementary to a curvature along a generally central front portion of an inside surface of the upper rim of the toilet, and including at least one magnet for removable, magnetic attachment to the magnetic plate. The magnetic plate is adhesively attached to the underside of the toilet, the guard is removably, magnetically attached to the magnetic plate, and when the toilet seat is in a seated position, the projecting member projects downwardly to an elevation below the upper rim of the toilet, thereby covering the gap between upper rim and the toilet seat along a generally central front portion of the toilet.

BRIEF DESCRIPTION OF THE DRAWINGS

The foregoing summary, as well as the following detailed description of the disclosure, will be better understood when read in conjunction with the appended drawings. For the purpose of illustrating the disclosure, there is shown in the drawings a preferred embodiment of a urine deflecting toilet seat attachment. It should be understood, however, that the disclosure is not limited to the precise arrangements and instrumentalities shown. In the drawings.

DESCRIPTION OF THE DISCLOSURE

Figure 1:
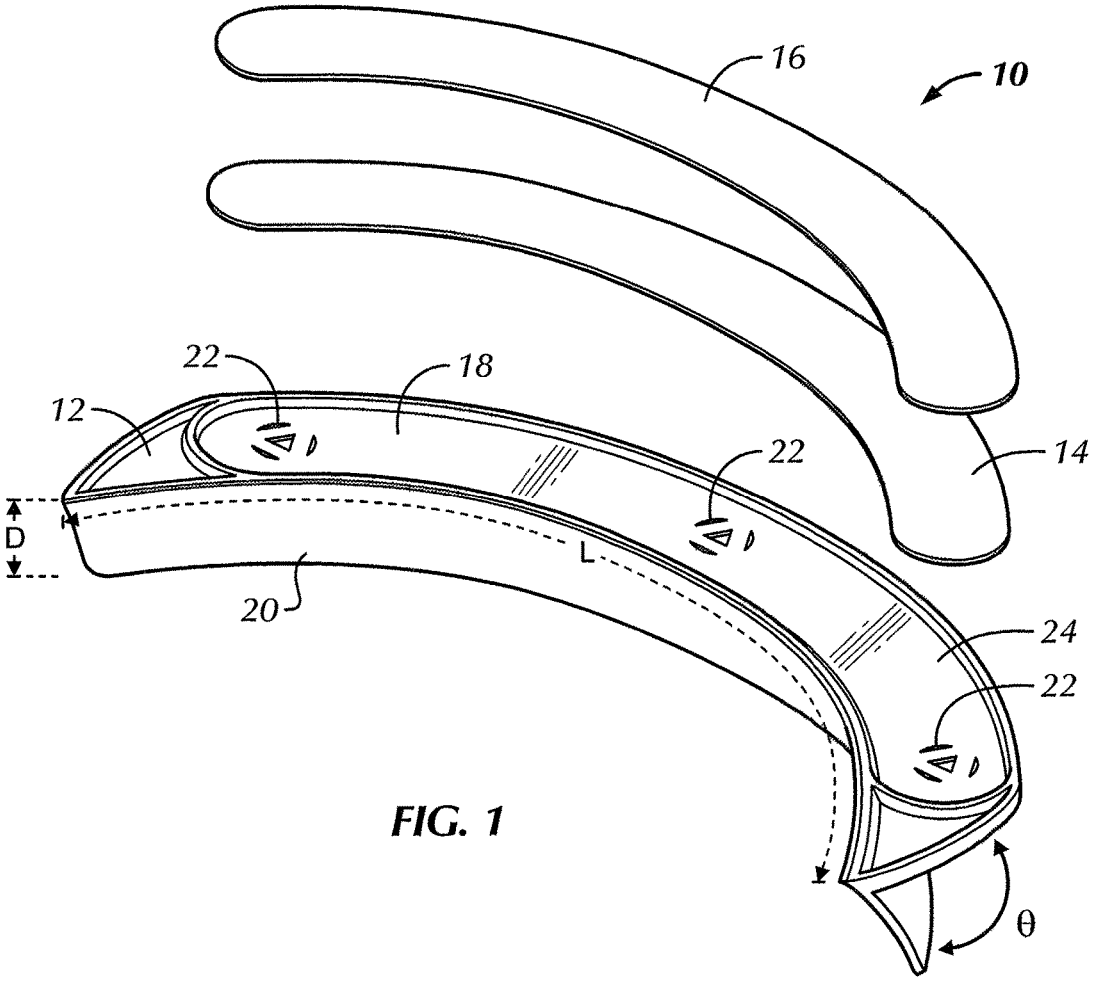
FIG. 1 is an exploded perspective view of a urine deflecting toilet seat attachment, according to a preferred embodiment of the invention.

Certain terminology is used in the following description for convenience only and is not limiting. The words "lower," "bottom," "upper" and "top" designate directions in the drawings to which reference is made. The words "inwardly," "outwardly," "upwardly" and "downwardly" refer to directions toward and away from, respectively, the geometric center of a western toilet or of the urine deflecting toilet seat attachment, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

Referring to the drawings in detail, wherein like numerals indicate like elements throughout, there is shown in FIGS. 1-4, a urine deflecting toilet seat attachment (hereinafter referred to as "urine deflector"), generally designated 10, removably attachable to an underside of a toilet seat 64 of a conventional western toilet 50. A conventional western toilet 50 (shown in FIG. 3) includes a tank 52, supported by an elongate bowl 54 having a generally oval shaped upper rim 56. As should be understood, the urine deflector 10 is equally usable with a western toilet or some other toilet having a rounded bowl or other curvature, without departing from the scope of the invention. The rim 56 defines a generally flat upper surface 58, an outside surface 60 and an inside surface 62. The toilet 50 further includes a toilet seat 64, having a generally oval shape, complimenting the generally oval shape of the rim 56. The toilet seat 64 is pivotably attached to the bowl 54, such as, for example, via a pair of hinges 66, and movable between an upright position and a down or seated position. The toilet seat 64 includes at least a pair of lugs 68 fixed to, and projecting downwardly from, an underside of the seat 64. The lugs 68 elevate the toilet seat 64 relative to the upper surface 58 of the rim 56, i.e., the top surface of the bowl 54, when the seat 64 is in the seated position, forming a gap between the seat 64 and the rim 56.

Figure 2A:
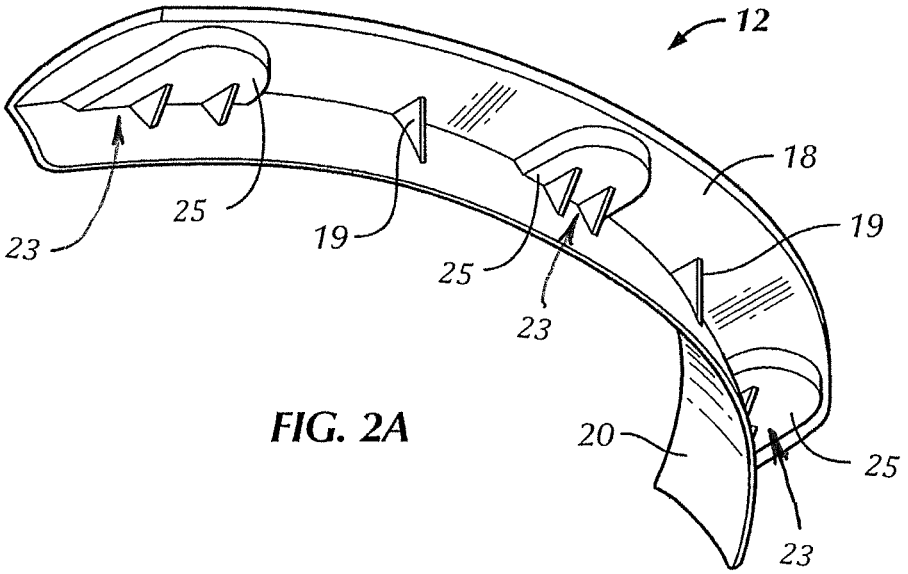
FIG. 2A is perspective bottom view of the urine deflecting attachment of FIG. 1.
Figure 2B:
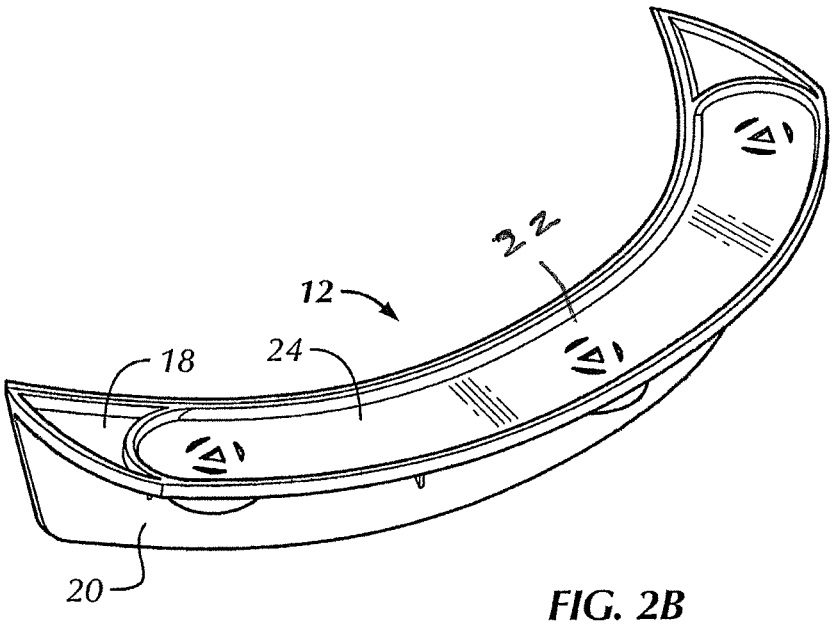
FIG. 2B is a perspective top view of the urine deflecting attachment of FIG. 1.
Figure 3:
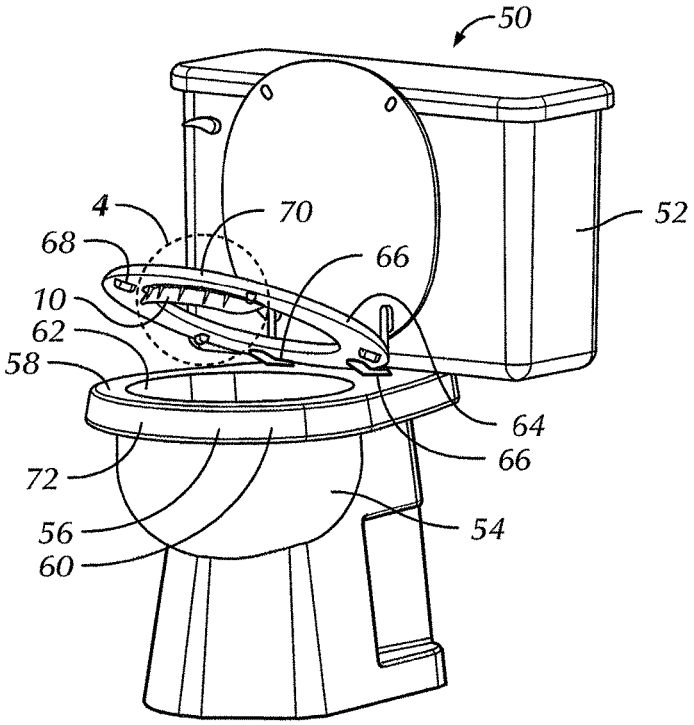
FIG. 3 is a side perspective view of the urine deflecting attachment of FIG. 1 assembled to a toilet seat of a western toilet.
Figure 4:
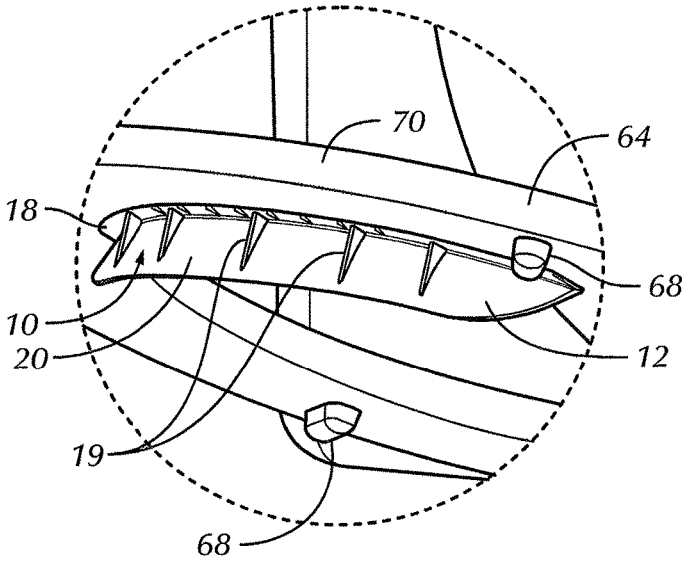
FIG. 4 is an enlarged perspective in view of the urine deflecting attachment assembled to the toilet seat of FIG. 3.

As shown in FIGS. 1, 2A and 2B, the urine deflector 10 comprises a guard member 12, a ferromagnetic plate 14, and an adhesive layer 16. As shown in FIG. 1, the guard member 12 includes a generally curved, planar top member 18 and a generally arcuate projecting member 20, projecting downwardly from the top member 18. The top member 18 defines a curvature complementary to the curvature along a generally central front portion 70 of the toilet seat 64, as shown in FIGS. 3 and 4. The arcuate projecting member 20 define a curvature complementary to the curvature along a generally central portion of the inside surface 62 of the upper rim 56 of the toilet 50. As should be understood by those of ordinary skill in the art, the guard member 12 defines an arc length L adapted to span at least a generally central front portion 72 of the rim 56 and the toilet seat 64. For example, the guard member 12 may define an arc length L between approximately 6 to 8 inches. However, as should be understood by those of ordinary skill in the art, the guard member 12 may define a great arc length L, in order to guard a greater or lesser portion of the toilet 50. As also should be understood, the depth D of the projecting member 20 is great enough to extend vertically at least slightly below the upper surface 58 of the rim 56 when assembled to the underside of the toilet seat 64 and the toilet seat 64 is in the seated position, thereby covering the gap between the toilet seat 64 and the rim 56, as discussed further below.

In the illustrated embodiment, the projecting member 20 defines a generally acute angle θ with the top member 18. However, as should be understood, the projecting member 20 may alternatively project generally perpendicularly downwardly from the top member 18 or define an obtuse angle relative thereto. In the illustrated embodiment, as shown best in FIG. 2A, the urine deflector 18 further includes a plurality of spaced apart support tabs 19 engaged between the top member 18 and the projecting member 20, increasing the structural rigidity of the guard member 12. However, as should be understood, the guard member 12 may alternatively have any number of support tabs 19, or alternatively have no support tabs 19.

In the illustrated embodiment, the top member 18 and the projecting member 20 are a monolithic, unitary structure, constructed, e.g., molded, of a polymeric material, such as, for example, without limitation, polypropylene. However, as should be understood by those of ordinary skill in the art, the top member 18 and the projecting member 20 may alternatively be made of any of numerous different polymeric or other materials. The guard member 12 may additionally be fragranced, i.e., scented. In one embodiment, the polymeric material utilized to construct the guard member 12 is mixed with fragrance infused plastic pellets prior to forming, e.g., molding, the guard member 12. The fragrance infused plastic pellets, such as, for example, without limitation, pellets infused with a fresh linen smell, comprise approximately 5% of the material utilized to form the guard member 12. Those of ordinary skill in the art should understand that the percentage of fragrance mixed into the polymeric material can vary depending on the desired strength and life of the fragrance desired. Thus, the guard member 12 also functions as a bathroom air freshener.

In the illustrated embodiment, the projecting member 20 also defines a generally equal depth along the curved length thereof. However, as should be understood, the projecting member 20 may alternatively define a maximum depth at a generally central portion thereof, and taper in depth to a minimum depth toward the opposing ends thereof.

As shown in FIGS. 1 and 2A, the guard member 12 further includes at least one magnet 22, e.g., an earth magnet, underlying the top member 18 within enclosed recesses 23. In the illustrated embodiment, the guard member 12 includes three spaced apart magnets 22. However, as should be understood, the guard member 12 may alternatively include a different number of magnets 22. In one embodiment, the magnets 22 may be over-molded with the top member 18 to additionally seal the magnets 22 and shield them from air and moisture.

As shown best in FIG. 2B, the top member 18 defines a groove 24 on an upper side thereof, i.e., above the magnets 22, complimentary in size and shape to the generally planar plate 14, for receiving the plate 14 therein. In the assembled state, with the plate 14 received within the groove 24, the magnets 22 are contained within substantially enclosed compartments, wells or bays 25. In the illustrated embodiment, the plate 14 is a magnetic stainless steel plate. However, as should be understood, the plate 14 may alternatively be constructed of other metallic or ferromagnetic materials. Accordingly the plate 14 is removably attachable to the guard member 12 via the magnetic force of the magnets 22. The double-sided adhesive layer 16, e.g., such as sold by the 3M Company, defines a complimentary size and shape to the size and shape of the plate 14 and is attached to a top layer of the plate 14, i.e., on the side of plate 14 not attached to the guard member 12. The adhesive layer 16 includes a liner layer (not shown) along the free side thereof, prior to installation, having a pull tab for easy removal.

To mount the urine deflector 10 to a toilet seat 64, a consumer first determines the correct position for the urine deflector 10 so that the toilet seat closes properly. To do so, the consumer lifts the toilet seat 64 and places the guard member 12 against the underside of the toilet seat 64 in an estimated proper position, i.e., along the inner circumference of the underside of the toilet seat 64, behind the lugs 68, along a generally central front portion 70 (between the front two lugs 68) thereof. Thereafter, the consumer completely lowers the toilet seat 64 into the seated position to ensure that the guard member 12 does not contact the toilet bowl 54. With the toilet seat 64 in the seated position, the guard member 12 should be positioned just inside the toilet bowl 54, blocking the gap between the toilet seat 64 and the rim 56. That is, the depth of the arcuate projecting member 20 is great enough to extend vertically at least slightly below the upper surface 58 of the rim 56. Upon adjusting the position of the guard member 12 appropriately, the consumer marks the position of the guard member 12, e.g., with a pencil, on the underside of the toilet seat 64. Thereafter, the liner layer covering the adhesive layer 16 is removed therefrom and the plate 14 is adhesively attached to the underside of the toilet seat 64, as shown in FIGS. 3 and 4, at the marked location. Once the plate 14 is attached to the underside of the toilet seat 64, the guard member 12 is magnetically, removably attachable to the plate 14, such that the plate 14 is received in the groove 24 of the top member 18 of the guard member 12.

In use, the projecting member 20 covers at least the generally central portion of the gap between the toilet seat 64 and the rim 56, and is capable of deflecting urine that splashes or squirts thereon downwardly into the toilet bowl 54. Whenever the guard member 12 is dirty or contaminated, e.g., by urine, a user may either disengage, i.e., by pulling, the guard member 12 from the plate 14, wash the guard member 12, and reengage the guard member 12 with the plate 14, or alternatively, merely replace the dirty or contaminated guard member 12 with a replacement guard member 12.

It will be appreciated by those skilled in the art that changes could be made to the embodiments described above without departing from the broad inventive concept thereof. It is understood, therefore, that this disclosure is not limited to the particular embodiments disclosed, but it is intended to cover modifications within the spirit and scope of the invention.

I claim:

1. A urine deflecting toilet seat attachment for assembly to a toilet having a toilet bowl defining a curved upper rim and a curved toilet seat pivotably attached to the toilet bowl and movable between an upright position and a seated position, and defining a gap between the upper rim and the toilet seat in the seated position thereof, the urine deflecting toilet seat comprising:

a generally arcuate elongate guard having a predetermined length and defining a length direction, removably attachable to the toilet seat, having a top member defining a curvature complementary to a curvature along a generally central front portion of the toilet seat, and a generally arcuate projecting member projecting downwardly from the top member and defining a curvature complementary to a curvature along a generally central front portion of an inside surface of the upper rim of the toilet, wherein, when the guard is removably attached to the toilet seat, and the toilet seat is in a seated position, the projecting member projects downwardly to an elevation below the upper rim of the toilet, thereby covering the gap between the upper rim and the toilet seat along a generally central front portion of the toilet and an elongate ferromagnetic plate generally configured to correspond to said generally elongate arcuate guard attachable to an underside of a toilet seat, and at least two magnets spaced from each other along the arcuate length direction of said elongate guard, for detachable magnetic attachment to said plate while maintaining said arcuate guard in a stable and, fixed orientation during use, said top member being provided with a groove in an upper side thereof for fittingly and removably receiving said ferromagnetic plate therein.

2. The urine deflecting toilet seat attachment of claim 1, further comprising an adhesive layer on said ferromagnetic plate for adhesively attaching said ferromagnetic plate to the underside of the toilet set.

3. The urine deflecting toilet seat attachment of claim 1, wherein the projecting member of the guard projects at an acute angle from the top member of the guard, wherein, when the guard is removably attached to the toilet seat, and the toilet seat is in a seated position, the projecting member projects inside the toilet bowl.

4. The urine deflecting toilet seat attachment of claim 1, wherein the generally arcuate guard defines an arc length between approximately 6 inches and approximately 8 inches.

5. The urine deflecting toilet seat attachment of claim 1, wherein the guard is comprised of a monolithic, polymeric material.

6. The urine deflecting toilet seat attachment of claim 5, wherein the polymeric material includes an infused fragrance.

7. The urine deflecting toilet seat attachment of claim 6, wherein the fragrance is infused in the form of pellets which comprise approximately 5% of the polymeric material.

8. A urine deflecting toilet seat attachment, for assembly to a toilet having a toilet bowl defining a curved upper rim and a curved toilet seat pivotably attached to the toilet bowl and movable between an upright position and a seated position, and defining a gap between the upper rim and the toilet seat in the seated position thereof, the urine deflecting toilet seat attachment comprising:

an elongate ferromagnetic plate defining a curvature complementary to a curvature along a generally central front portion of the toilet seat;

an adhesive layer on the magnetic plate for adhesively attaching the magnetic plate to an underside of the toilet set;

a generally arcuate elongate guard having a top member defining a curvature complementary to the curvature of said ferromagnetic plate, a generally arcuate projecting member projecting downwardly from the top member and defining a curvature complementary to a curvature along a generally central front portion of an inside surface of the upper rim of the toilet, and including at least two magnets spaced from each other along the length direction of said elongate guard for detachable magnetic attachment to said ferromagnetic plate to maintain said arcuate guard in a stable and fixed orientation during use;

wherein, when the magnetic plate is adhesively attached to the underside of the toilet, the guard is detachably magnetically attached to said ferromagnetic plate, and when the toilet seat is in a seated position, the projecting member projects downwardly to an elevation below the upper rim of the toilet, thereby covering the gap between upper rim and the toilet seat along a generally central front portion of the toilet, said top member defining a groove in an upper side thereof for fittingly and removably receiving said ferromagnetic plate therein.

9. The urine deflecting toilet seat attachment of claim 8, wherein the projecting member of the guard projects at an acute angle from the top member of the guard, wherein, when the guard is removably attached to the magnetic plate, and the toilet seat is in a seated position, the projecting member projects inside the toilet bowl.

* * * * *